US006685309B2

(12) United States Patent
Jones et al.

(10) Patent No.: US 6,685,309 B2
(45) Date of Patent: Feb. 3, 2004

(54) GEOMETRIC INK CHANNELS FOR INK CARTRIDGE

(75) Inventors: Bruce S. Jones, Franklin, TN (US); William A. Putman, Franklin, TN (US)

(73) Assignee: Seiko Epson Corporation, Nagano-ken (JP)

( * ) Notice: Subject to any disclaimer, the term of this patent is extended or adjusted under 35 U.S.C. 154(b) by 0 days.

(21) Appl. No.: 10/148,984

(22) PCT Filed: Oct. 5, 2001

(86) PCT No.: PCT/US01/31232

§ 371 (c)(1),
(2), (4) Date: Jun. 4, 2002

(87) PCT Pub. No.: WO02/28643

PCT Pub. Date: Apr. 11, 2002

(65) Prior Publication Data

US 2003/0048337 A1 Mar. 13, 2003

Related U.S. Application Data

(60) Provisional application No. 60/239,081, filed on Oct. 6, 2000.

(51) Int. Cl.[7] ..... B41J 2/175

(52) U.S. Cl. ..... 347/86

(58) Field of Search ..... 347/85, 86, 87, 347/92, 93

(56) References Cited

U.S. PATENT DOCUMENTS

| | | | | | |
|---|---|---|---|---|---|
| 5,821,965 | A | * | 10/1998 | Oda et al. | 347/86 |
| 5,875,615 | A | * | 3/1999 | Ito et al. | 53/474 |
| 6,170,941 | B1 | * | 1/2001 | Hara et al. | 347/86 |
| 6,238,042 | B1 | * | 5/2001 | Kobayashi et al. | 347/86 |
| 6,325,499 | B1 | * | 12/2001 | Betschon | 347/86 |

* cited by examiner

*Primary Examiner*—Anh T. N. Vo
(74) *Attorney, Agent, or Firm*—Squire, Sanders & Dempsey L.L.P.

(57) ABSTRACT

An ink supply tank has a plurality of walls forming a cavity and a bottom wall formed with an ink outlet port. An ink absorbing member is disposed within the cavity positioned adjacent the ink outlet port. A plurality of grooves are recessed within the bottom wall and have a depth which gradually increases toward the ink outlet port. The grooves are approximately parallel to and are equally spaced apart from each other. The grooves extend along the longitudinal axis of the tank and are of the same width. A pair of grooves also extend along a transverse axis of the tank and are positioned on opposed sides of the ink outlet port and are parallel to each other. The transverse grooves have a width greater than the width of the longitudinal grooves.

20 Claims, 6 Drawing Sheets

GEOMETRIC INK CHANNELS FOR INK CARTRIDGE

CROSS-REFERENCE TO RELATED APPLICATIONS

This application claims priority from Provisional Application No. 60/239,081 filed on Oct. 6, 2000.

BACKGROUND OF THE INVENTION

This invention relates generally to the ink-jet printing art for ejecting ink droplets onto a recording medium such as paper, and more particularly, an ink tank cartridge for use in an ink-jet type recording apparatus such as a printer.

In a conventional recording apparatus, ink is supplied to a recording head from an ink tank constructed as a cartridge. A benefit of using an ink cartridge serving as an ink tank is that ink does not smear due to the leakage of ink while refilling new ink or the like. However, undesired air bubbles can easily enter the ink tank during the filling process which causes problems such as ink supply failure.

Controlling the flow of ink from the cartridge is also a concern. Capillary flow of ink in a foam is well known, having been practiced in oil based re-inking cassettes. Several versions of ink-jet cassettes have extended ribs to force ink to migrate, by capillary flow, toward an outlet port, such as a radial web of V-shaped grooves with the width of the groove increasing as it moves toward the outlet port. Occasionally these grooves leave some "dead" areas near the porous member where ink does not have the ability to flow toward the ink outlet port.

Increasing the efficiency and yield of ink flow to an ink outlet port through increased flow rate channels is desired. This can be achieved by geometrically positioning recessed grooves in an inside surface of the cartridge. The grooves would be consistent in width to maintain constant flow rate of ink to the nozzle outlet port. Accordingly, it is desirable to develop a new and improved ink cartridge which would overcome the these deficiencies and others while meeting the above-stated needs to provide better, more advantageous overall results.

SUMMARY OF THE INVENTION

Generally speaking, in accordance with the invention, an ink tank cartridge is provided for an ink-jet type recording apparatus being removably mounted on the ink supply needle of a recording body.

More particularly, the invention relates to an ink supply cartridge for an ink-jet printer comprising an ink supply tank with a plurality of walls forming a cavity and a bottom wall formed with an ink outlet port. An ink absorbing member is disposed within the cavity positioned adjacent the ink outlet port. A groove is recessed within the bottom wall for transferring ink to the ink outlet port and has a depth which gradually increases toward the ink outlet port. The groove may have a plurality of grooves which are approximately parallel to and are equally spaced apart from each other. The grooves extend along the longitudinal axis of the tank and are of the same width. A pair of grooves extend along a transverse axis of the tank and are positioned on opposed sides of the ink outlet port and are parallel to each other. The transverse grooves have a width greater than the width of the longitudinal grooves. The transverse grooves are disposed approximately normal to the longitudinal grooves and serve as drains for the ink adjacent the ink outlet port. The grooves are equally spaced apart a width which corresponds to the width of the grooves. A filter is positioned above the longitudinal and transverse grooves.

The groove may alternately be comprised of sections which are approximately normal to each other and extend from one side of the ink outlet port to an opposite side. The groove is of a uniform depth and width and forms a serpentine configuration. The ink outlet port comprises an opening which has a series of walls formed at an angle to each other.

Still other aspects of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE PREFERRED EMBODIMENTS

Figure 1:
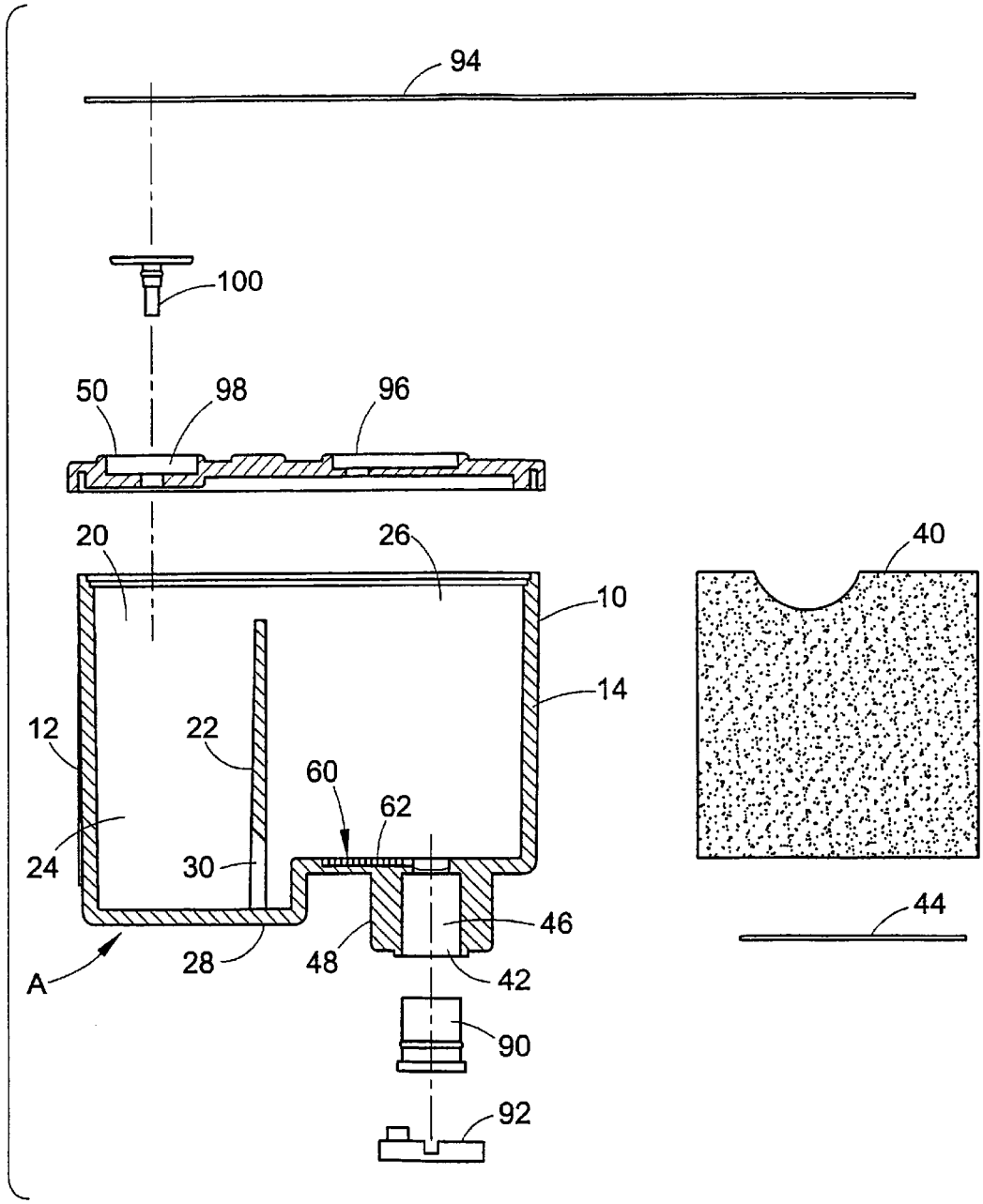
FIG. 1 is an exploded elevational view in cross-section of an ink cartridge according to a first embodiment of the present invention.
Figure 2:
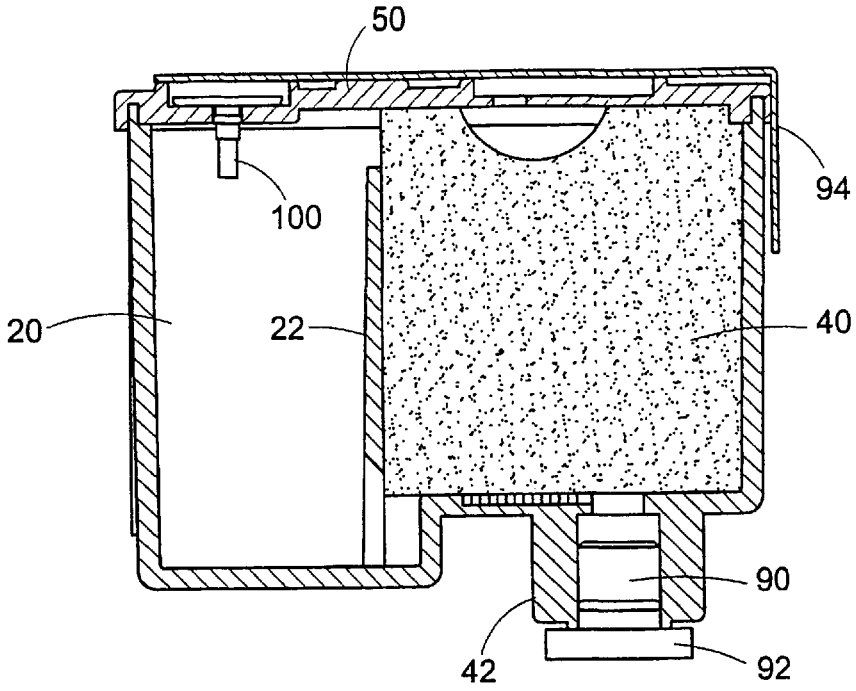
FIG. 2 is a side elevational view in cross-section of the ink cartridge of FIG. 1.

Referring now to the drawings, wherein the showings are for purposes of illustrating preferred embodiments of the invention only and not for purposes of limiting same, FIG. 1 shows an ink tank cartridge A according to one embodiment of the present invention.

More specifically, the ink tank cartridge comprises a case or housing 10 which defines an internal chamber of a generally rectangular cross section. The housing is formed by a series of walls 12, 14, 16, 18, which together form an internal cavity 20. An additional dividing wall 22 separates the housing internal cavity into first and second chambers 24, 26. Here, the chambers are substantially equally sized. The wall 22 extends laterally between opposed sides of the housing and extends upwardly from a housing bottom wall 28 to an open top end of the housing effectively dividing the internal chamber into discrete first and second chambers. An opening 30 extends through a lower region of the wall 22 adjacent to the bottom wall of the housing placing the first and second chambers into communication with each other for ink storage and transfer purposes. Chamber 24 is used to store free ink while chamber 26 is used to store ink in an ink absorbing or porous member 40.

Figure 3:
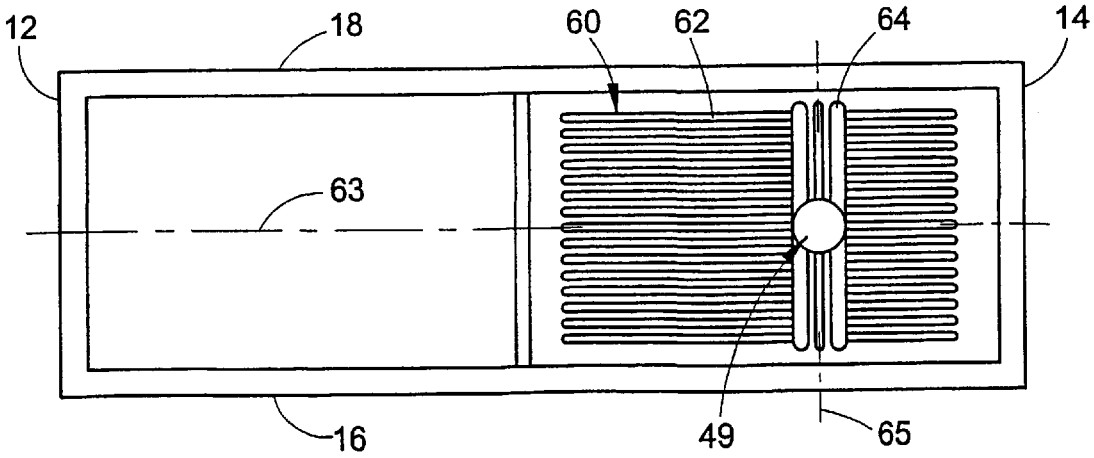
FIG. 3 is a top elevational view of a bottom wall in the interior of the ink cartridge of FIG. 1.

The ink absorbing member comprises a block of porous material or foam and is formed of Melamine™ or hydrophilic foam. It will be appreciated, however, that other materials may be used for storing ink without departing from the scope and intent of the present invention. The absorbing member is disposed in the chamber 26 and adjacent an outlet port 42. Outlet port 42 is positioned within the bottom wall of the housing. A filter or screen 44 is inserted in the cartridge over the outlet within the housing prior to insertion of the ink absorbing member. The screen is interposed between the ink absorbing member and the outlet port to prevent egress of air bubbles, contaminants, and the like from the cartridge. The outlet port 42 comprises an opening 46 and a pipe-like or chimney member 48 which extends from the bottom wall of the housing. Opening 46 communicates with an opening 49 (FIG. 3) in the bottom wall.

After the ink absorbing member has been installed and properly positioned in the second chamber 26, a cover 50 is fixedly secured to the housing, for example, by ultrasonic welding. The height of the ink absorbing member is slightly less than the inside height of the housing and is measured between the bottom wall and the underside of the cover. Thus there is no compression of the ink absorbing member in a vertical direction. The ink absorbing member has pore sizes which are larger than those in the filter screen.

Figure 4:
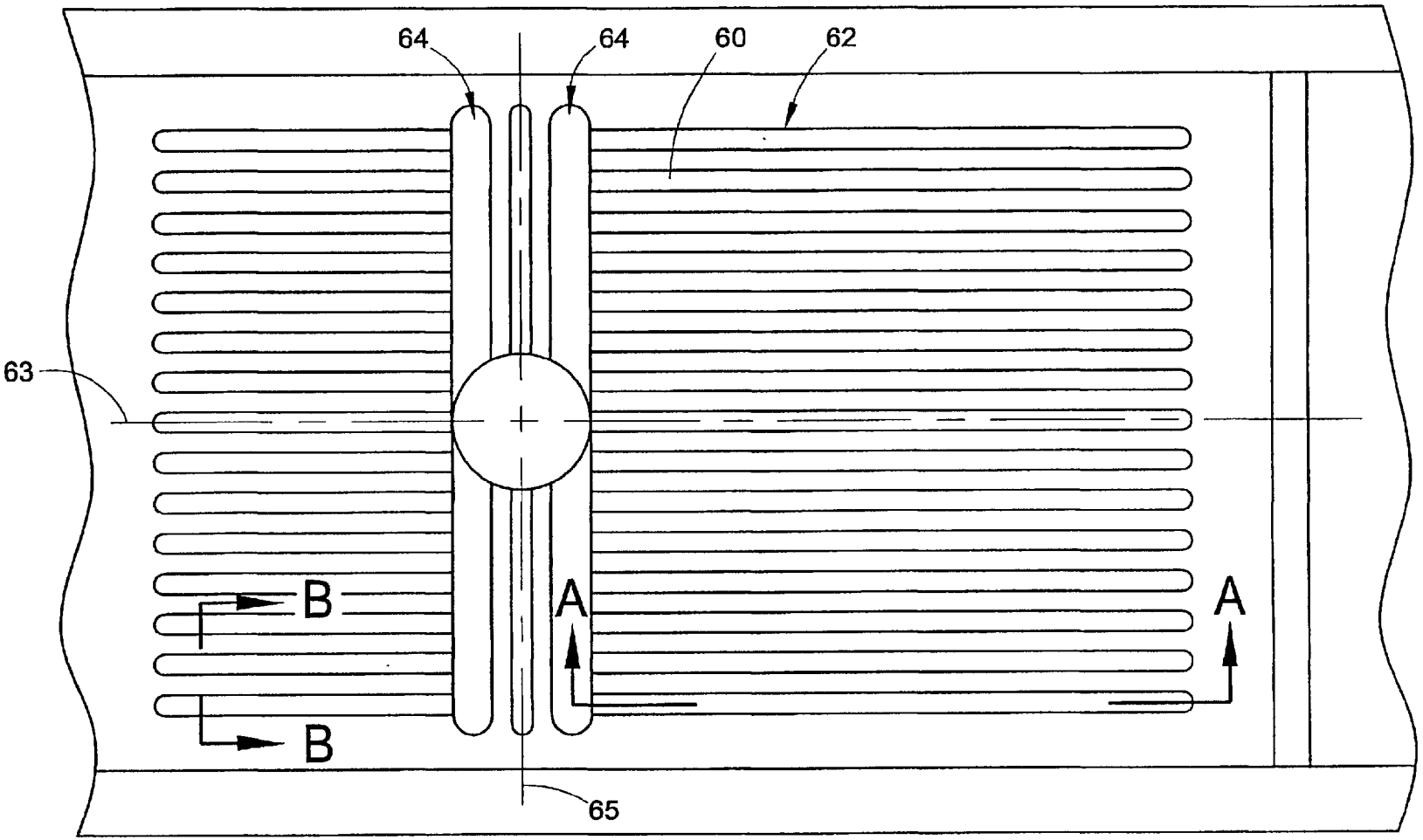
FIG. 4 is an enlarged top plan view of the bottom wall of the cartridge illustrating recessed grooves.

The filter screen is thermally sealed over recessed grooves 60 forming a geometric pattern located within the bottom wall of the cartridge in the preferred arrangement. As shown in FIG. 4, in accordance with a first embodiment of the present invention, a series of channels or grooves 62 extend from the outlet port and are used to transfer and draw ink to the outlet port. The channels 62 extend along a longitudinal axis 63 and are approximately parallel to each other. Ink channels 62 may be equally spaced from each other and are embedded or recessed in the internal surface of the bottom of the ink-jet cartridge. The grooves have the same, constant widths. Furthermore, the width of each groove corresponds to the spacing between the grooves. The coverage area of the grooves encompasses a substantial area under the ink absorbing member. Grooves 62 each have a depth which preferably increases as the grooves approach the outlet port.

Figure 5A:
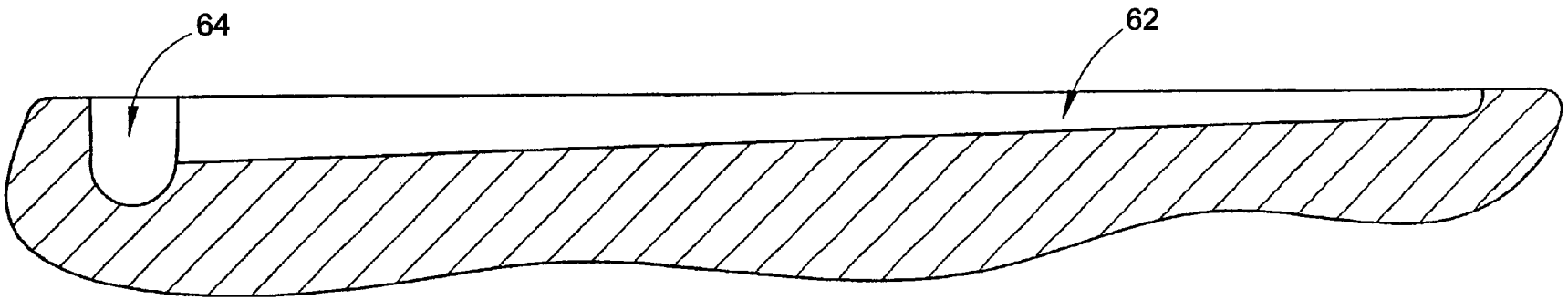
FIG. 5A is a view along section A—A of FIG. 4.
Figure 5B:
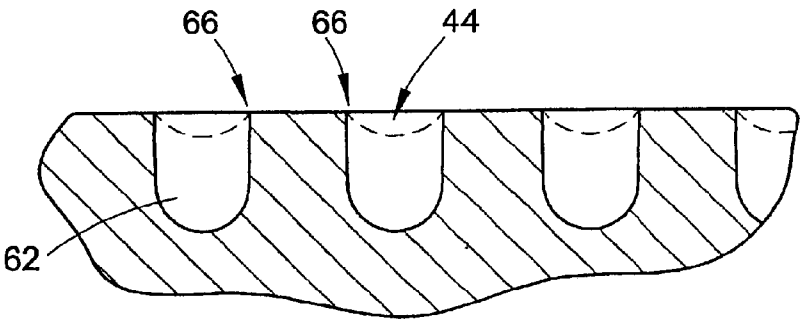
FIG. 5B is a view along section B—B of FIG. 4.

A second set of grooves 64 is disposed along a transverse axis 65 with respect to the first set of grooves 62 and is approximately normal to the first set of grooves. Grooves 64 are preferably of a greater width than grooves 62 to form a sink or catch drain which has an increased ink volume from the other channels or grooves. Grooves 64 are approximately parallel to each other and have the same widths. The ink absorbing member contacts the bottom surface of ink-jet cartridge above the grooves or channels. The porous member is positioned with the intent of conveying ink to the ink outlet port. As seen in FIG. 5A, as the groove(s) extends toward the ink outlet port it slopes or increases in depth. As seen in FIG. 5B, concentration points 66 occur as the porous member and screen 44 are depressed into grooves 62. The grooves 62, 64 are completely recessed within the bottom wall. Grooves 64 are approximately double the width of the other grooves and serve as catch drains of increased volume as ink is conveyed thereto from grooves 62.

One function of this ink groove configuration is to increase the overall ink flow rate in the cartridge. This configuration also increases the overall yield or efficiencies of the grooves by allowing more ink to be removed as compared to the amount that is initially filled in the cartridge. The area and velocity relationships for a fluid referenced in Handbook for Mechanical Engineers, 8th Edition, Page 3–43, state that as area increases the velocity decreases and that if the area is constant the flow is constant. The formula for calculation of flow rate in a flow channel is $D^*A/A=-(D^*V/V)$ where D=diameter of cross section, A=total area of ink channel, and V=velocity of ink in the ink channel.

Figure 6:
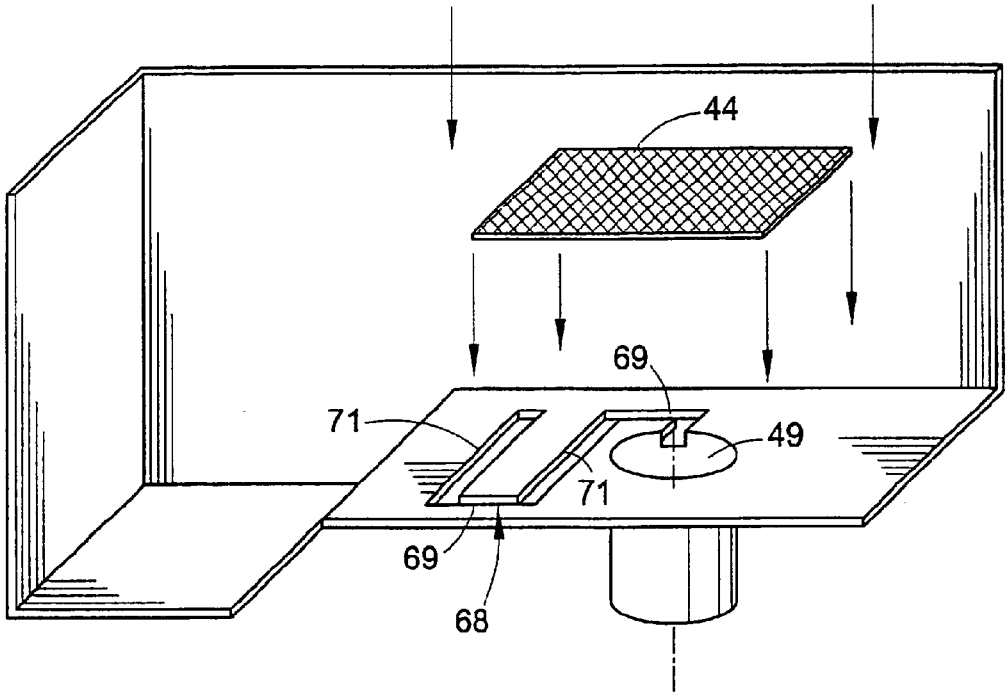
FIG. 6 is a cut-away perspective view of an ink cartridge in accordance with a second embodiment.
Figure 8:
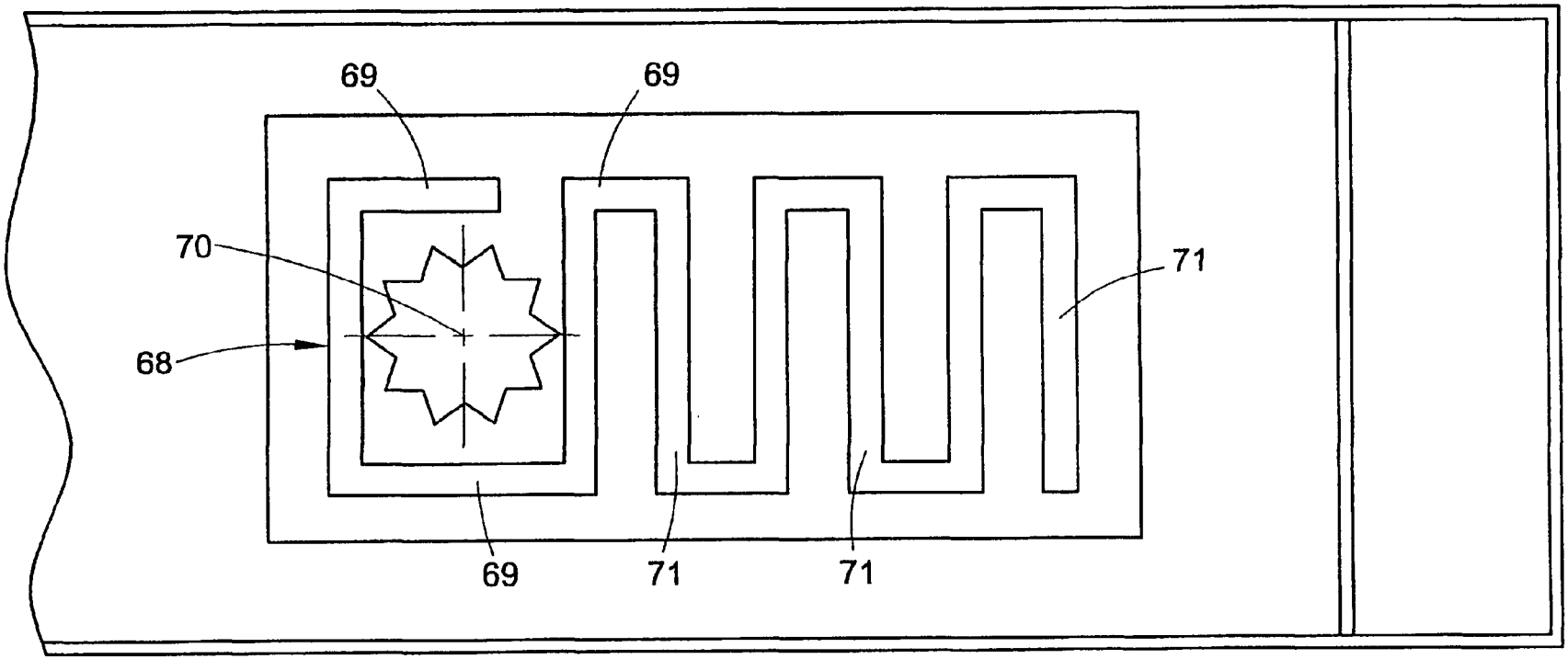

In an alternate embodiment, shown in FIG. 6, the geometric pattern of grooves can be in the form of a single serpentine groove 68. The serpentine groove comprises portions 69 along a longitudinal axis of the cartridge and portions 71 along transverse axes. The serpentine groove is recessed in the bottom wall of the ink-jet cartridge which enables larger contact area with the porous member. The filter element fits over the single serpentine groove on the bottom of the cartridge. The serpentine groove provides a defined passage for ink to flow toward the ink outlet port. As shown in FIG. 8, the serpentine groove can have additional groove portions and also can surround a star-shaped hole 70 in the ink outlet port. The star-shaped hole likewise aids in ink flow through the outlet port.

Figure 7:
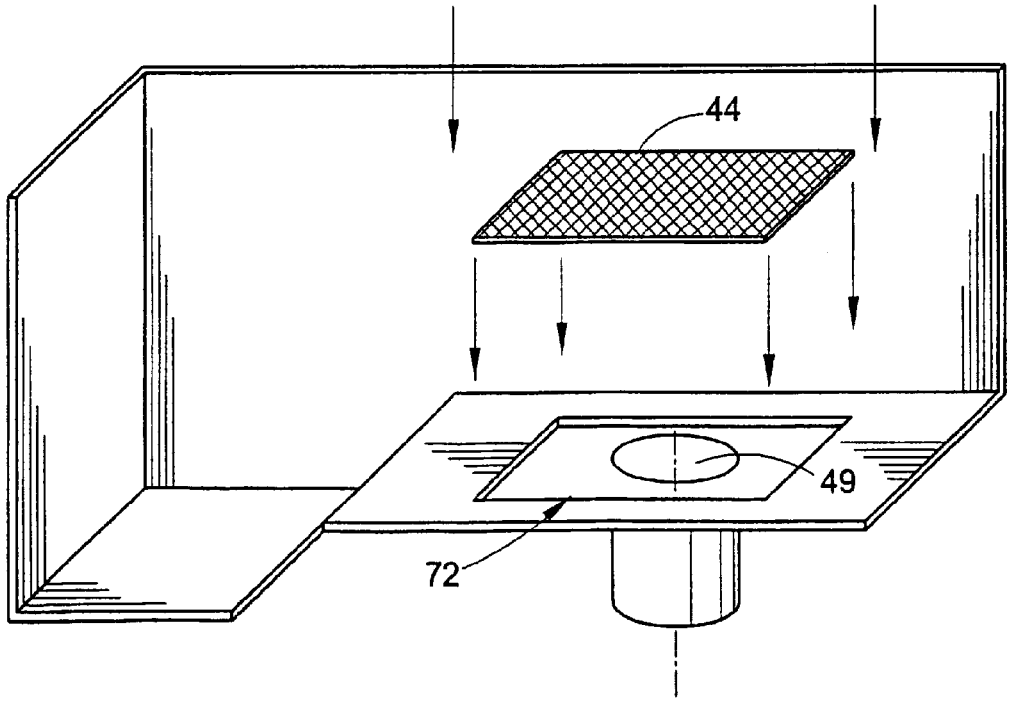
FIG. 7 is a top plan view of an ink cartridge in accordance with a third embodiment; and, FIG. 8 is a cut-away perspective view of an ink cartridge in accordance with a fourth embodiment.

In another alternate embodiment seen in FIG. 7, the bottom wall of the cartridge has a recessed pocket 72 in which the filter element is placed. This alternate configuration simplifies assembly of the filter screen. The recess pocket surrounds the ink outlet port and allows the filter screen to fit inside the bottom wall and cover a large portion of the surface area of the bottom wall. The filter element for screening also advantageously provides a wicking action with respect to the ink and aids in flow of the ink to the outlet port.

A seal member or grommet 90 is inserted into the chimney member 48 through opening 46. A closed end of the grommet is pierced to create an ink supply withdraw opening only when and as the cartridge is mounted in a printer. A grommet retaining ring 92 is placed onto the outer end of the chimney and is ultrasonically welded into place. Each ring has a central opening to provide access to the grommet and outlet port.

The cover has a fill hole 96 and a recessed, vent passage 98, and is attached to the cartridge housing forming a fluid-tight seal therewith. Retained in the vent passage is a seal for selectively permitting the passage of fluid between the interior and the exterior of the cartridge. The seal is in the form of a check valve 100. However, it will be appreciated that the seal may take the form of any suitable sealing member, including a septum seal plug. The check valve 100 forms a one-way fluid passage between the interior and the exterior of the cartridge, permitting fluid to pass from the interior of the cartridge while preventing any substantial flow of fluid from the exterior to the interior of the cartridge.

The assembled cartridge is inserted in a fixture and the region around the fill hole is sealed so that a negative pressure (a pre-fill vacuum of 27.5 in Hg within the cartridge) is applied to the cartridge through the fill hole to remove air from the open cells within the porous member.

The cartridge is subsequently filled with ink through the fill hole of the cover using degassed ink. Either black ink or different color inks, i.e. cyan, magenta, and yellow ink, may be introduced into the chamber(s) of the cartridge. The ink is introduced under pressure into the cartridge to maximize the amount of ink for consumer end use and minimize the likelihood of air bubble entrapment.

After the cartridge has been evacuated and pressure filled, the cartridge is again evacuated through the filling port to degas the ink which may have retained air during the filling operation. The filling port is then sealed, such as by seal film 94, and a negative pressure is applied to the cartridge through the check valve which opens in response to the negative pressure causing the generation of a negative pressure within the cartridge. Once the vacuum pressure is discontinued, the one-way check valve closes retaining the negative pressure within the cartridge. Subsequently, the remainder of the cartridge cover is sealed with a laminate seal thermally attached to the remaining portion of the cover over the diaphragm valve to seal air from the cartridge until the seal is removed by the consumer when the cartridge is installed on the printer. It will be appreciated that the fill hole is utilized as a vent hole after the foil seal is removed by the consumer.

Prior to shipment, each cartridge is shrink wrapped with an air permeable cellophane type material. By shrink wrapping the cellophane over the cartridge, any potential leakage of ink from the cartridge into a packaging bag is limited.

The invention has been described with reference to several preferred embodiments. Obviously, alterations and modifications will occur to others upon a reading and understanding of the specification. It is intended to include all such modifications and alterations insofar as they come within the scope of the appended claims or the equivalents thereof.

Having thus described the invention, it is claimed:

1. An ink supply cartridge for an ink-jet printer comprising:

an ink supply tank having a plurality of walls forming a cavity and a bottom wall formed with an ink outlet port in said bottom wall;

an ink absorbing member disposed within said cavity positioned adjacent said ink outlet port; and a groove recessed within said bottom wall for transferring ink to said ink outlet port, wherein said groove has a width which remains constant and a depth which gradually increases toward said ink outlet port.

2. The ink supply cartridge of claim 1, wherein said groove comprises a plurality of grooves which are approximately parallel to and equally spaced from each other.

3. The ink supply cartridge of claim 2, wherein each of said grooves are the same width.

4. The ink supply cartridge of claim 3, wherein each of said grooves are equally spaced apart a width which corresponds to the width of the grooves.

5. The ink supply cartridge of claim 2, wherein said grooves extend along a longitudinal axis of said tank.

6. The ink supply cartridge of claim 5, further comprising a pair of grooves along a transverse axis of said tank.

7. An ink supply cartridge for an ink-jet printer comprising:

an ink supply tank having a plurality of walls forming a cavity and a bottom wall formed with an ink outlet port in said bottom wall;

an ink absorbing member disposed within said cavity positioned adjacent said ink outlet port; and, a groove recessed within said bottom wall for transferring ink to said ink outlet port, wherein said groove has a depth which gradually increases toward said ink outlet port, said groove comprises a plurality of grooves which are approximately parallel to and equally spaced from each other, said grooves extend along a longitudinal axis of said tank, a pair of grooves along a transverse axis of said tank wherein said transverse grooves are positioned on opposed sides of said ink outlet port and are generally parallel to each other.

8. The ink supply cartridge of claim 7, wherein said transverse grooves each have a width greater than the width of said longitudinal grooves.

9. The ink supply cartridge of claim 8, wherein said transverse grooves are disposed approximately normal to said longitudinal grooves.

10. The ink supply cartridge of claim 7, wherein said transverse grooves serve as drains for ink adjacent said ink outlet port.

11. The ink supply cartridge of claim 7, further comprising a filter positioned in an overlying relation to said longitudinal and transverse grooves.

12. An ink supply cartridge for an ink-jet printer comprising:

an ink supply tank having a plurality of side walls and a bottom wall formed with an ink outlet port in said bottom wall;

an ink absorbing member positioned adjacent said bottom wall in between said side walls; and, a groove in said bottom wall, said groove having sections along a longitudinal axis of said tank and sections along a transverse axis of said tank, said longitudinal sections and transverse sections are connected at their respective ends with the respective interconnected sections being approximately normal to each other to form a serpentine groove.

13. The ink tank cartridge of claim 12, wherein each of said grooves sections has a depth which gradually increases toward said ink outlet port.

14. An ink supply cartridge for an ink-jet printer comprising:

an ink supply tank having a plurality of side walls and a bottom wall formed with an ink outlet port in said bottom wall;

an ink absorbing member positioned adjacent said bottom wall and between said side walls;

a filter element positioned on said bottom wall between said ink absorbing member and said bottom wall; and at least one groove in said bottom wall, said at least one groove having longitudinal sections which are approximately normal to transverse sections, said at least one groove having sections that extend from one side of said ink outlet port to an opposite side of said ink outlet port.

15. An ink supply cartridge for an ink-jet printer comprising:

an ink supply tank having a plurality of side walls and a bottom wall formed with an ink outlet port in said bottom wall;

an ink absorbing member positioned adjacent said bottom wall and between said side walls;

a filter element positioned on said bottom wall between said ink absorbing member and said bottom wall; and, at least one groove having sections which are approximately normal to each other and extend from one side of said ink outlet port to an opposite side of said ink outlet port wherein said groove is of a uniform depth and width.

16. An ink supply cartridge for an ink-jet printer comprising:

an ink supply tank having a plurality of side walls and a bottom wall formed with an ink outlet port in said bottom wall;

an ink absorbing member positioned adjacent said bottom wall and between said side walls;

a filter element positioned on said bottom wall between said ink absorbing member and said bottom wall; and, at least one groove having sections which are approximately normal to each other and extend from one side of said ink outlet port to an opposite side of said ink outlet port wherein said groove forms a serpentine configuration.

17. The ink supply cartridge of claim 14, wherein said ink supply port comprises an opening which has a series of walls which are formed at an angle to each other.

18. The ink supply cartridge for an ink-jet printer comprising:

an ink supply tank having a plurality of side walls and a bottom wall formed with an ink outlet port in said bottom wall;

a recess portion within said bottom wall surrounding said ink outlet port;

a filter element positioned on said bottom wall and fitted within said recess portion said filter element having a thickness approximately equal to the depth of said recess portion; and an ink absorbing member positioned above said bottom wall in between said side walls.

19. An ink supply cartridge for an ink-jet printer comprising:

an ink supply tank having a plurality of walls forming a cavity and a bottom wall formed with an ink outlet port in said bottom wall;

an ink absorbing member disposed within said cavity positioned adjacent said ink outlet port;

a plurality of grooves recessed within said bottom wall for transferring ink to said ink outlet port, wherein each of said grooves has a depth which gradually increases towards said ink outlet port, wherein said grooves are generally parallel and are equally spaced apart, said grooves extend along a longitudinal axis of said cartridge; and, a pair of grooves along a transverse axis of said cartridge, said grooves being positioned on opposed sides of said ink outlet port and being generally parallel to each other.

20. The ink supply cartridge of claim 19, wherein said transverse grooves each have a width greater than the width of said longitudinal grooves.

* * * * *